United States Patent [19]

Best

[11] 4,075,878

[45] Feb. 28, 1978

[54] CABLE LOCK

[76] Inventor: Walter E. Best, Best Lock Corporation, P.O. Box 103, Indianapolis, Ind. 46206

[21] Appl. No.: 694,685

[22] Filed: Jun. 10, 1976

[51] Int. Cl.[2] ..... E05B 67/06

[52] U.S. Cl. ..... 70/49; 70/369

[58] Field of Search ..... 70/14, 15, 18, 30, 49, 70/369

[56] References Cited

U.S. PATENT DOCUMENTS

| | | | |
|---|---|---|---|
| 1,520,902 | 12/1924 | Junkune | 70/18 UX |
| 3,728,879 | 4/1973 | Best | 70/38 R |

FOREIGN PATENT DOCUMENTS

| | | | |
|---|---|---|---|
| 812,771 | 9/1951 | Germany | 70/49 |

*Primary Examiner*—Robert L. Wolfe

*Attorney, Agent, or Firm*—Jenkins, Coffey & Hyland

[57] ABSTRACT

A cable lock has a key-removable core of figure-8 shape mounted in a two-lobe axial chamber at one end of a lock body. The key plug of the core drives a rotary bolt mounted in a blind extension of one chamber lobe. The bolt releasably locks one cable end member inserted in a blind axial bore at the other end of the body, which bore is parallel with and overlaps the extension and lies opposite the second lobe of the core chamber. The other end member of the cable is inserted in a transverse blind bore located axially between the second chamber lobe and the axial cable-receiving bore, and is secured by a retaining pin inserted through the core chamber and concealed by the core in such chamber. In one modification, insertion of the releasable cable end member requires key actuation of the core. In a second modification, the rotary bolt has a rotatable cam head biased to locking position but formed with a cam surface so arranged that the head is rotated to a cable-receiving position when the releasable cable end member is thrust against it in the cable-receiving bore.

18 Claims, 9 Drawing Figures

CABLE LOCK

SUMMARY OF THE INVENTION

This invention relates to a cable lock of improved construction and operating characteristics.

In accordance with the invention, a cable lock comprises a cable having opposite end members, and a lock body having a core chamber formed at one end to receive a lock core, an axial bore at the opposite end to receive one cable end member, and a transverse bore intermediate its length to receive the other cable end member. The lock core is preferably a key-removable core having a key-actuated key plug, and preferably has a cylindrical body portion in which the key plug is coaxial and rotatable, and a laterally extending tumbler housing portion. The latter is preferably also of cylindrical shape so that the core is of figure-8 cross section. The core chamber has a cross sectional shape corresponding to that of the core, and for a figure-8 core is conveniently formed as a pair of parallel overlapping bores. A bolt chamber bore extends inward from the bottom of the core chamber in coaxial relation with the key plug of the core, and contains a rotary bolt trapped between the blind end of the bore and the inner end of the lock core and connected for rotation by the key plug.

The axial cable-receiving bore at the opposite end of the body lies in parallel overlapping relation with the bolt bore, and preferably in general axial alignment with the tumbler-housing portion of the core chamber. The transverse second cable-receiving bore in the lock lies beyond the inner end of the core chamber and is offset laterally from the bolt-receiving bore. In the preferred arrangement, such transverse cable-receiving bore lies axially between the first cable-receiving bore and the tumbler-housing portion of the core chamber.

The one cable end member is releasably locked against withdrawal from the axial first cable-receiving bore by means of the rotary bolt. For this purpose, the cable end member preferably has an annular groove which defines a head at the end of the cable, and the rotary bolt has a complementary head and groove which interengage with the groove and head of the end member. The rotary bolt is cut away at one side to form an axial side channel which comes into alignment with the cable-receiving bore when the bolt is turned to release position by key actuation of the core, so as to permit the releasable cable end member to be withdrawn from the body.

The other cable end member is secured in the transverse second cable-receiving bore and held therein by a pin inserted through the core chamber and concealed and protected by the core in such chamber. Preferably, the pin is engaged in an annular groove in the end member so that the cable end member is free to rotate in the transverse cable-receiving bore.

In one modification, insertion of the releasable cable end member into engagement with the body and rotary bolt requires key actuation of that bolt to its release position. In a second modification, the rotary bolt comprises a body portion which is rotatable by the key plug and a rotatable cam head which is biased to locking position and which has a cam face by which it is rotated with respect to the body portion, against the biasing means, to a cable passing position in response to axial thrust of the releasable cable end member into the cable-receiving bore and against the cam face.

BRIEF DESCRIPTION OF THE DRAWINGS

The accompanying drawings illustrate the invention and show preferred and exemplifying embodiments of the two modifications. In such drawings.

DESCRIPTION OF THE PREFERRED EMBODIMENT

Figure 1:
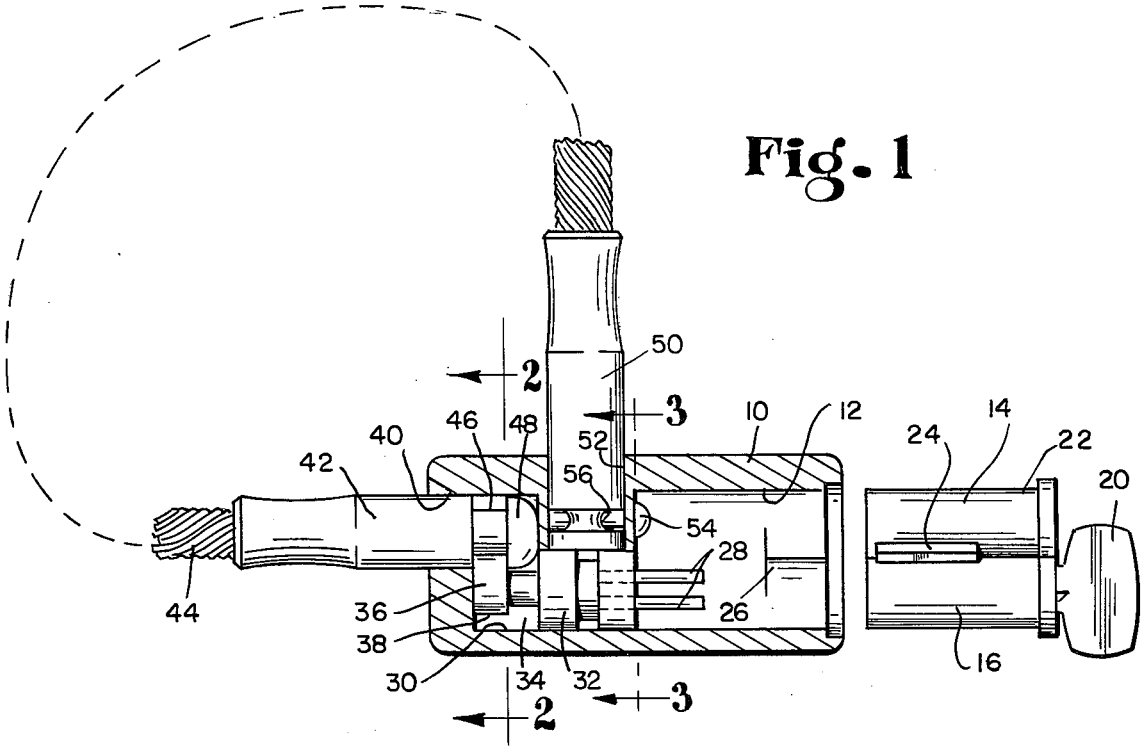
FIG. 1 is a longitudinal section of a cable lock embodying the invention, in which the bolt must be key-actuated to permit insertion of the free end of the cable, with the lock core shown in exploded relation with the lock body.

The lock shown in FIGS. 1–4 comprises a lock body 10 having a core chamber 12 formed in its end for the reception of a key-removable core 14. The core 14 of the type shown in Pat. No. 3,206,959 of Sept. 21, 1965. Such core comprises a lower lobe 16 containing a key plug 18 having a key slot for the reception of a key 20, and having at the rear a pair of diametrically spaced holes for the reception of a pair of throw pins 28. The core also has an upper lobe 22 containing the tumbler pins of the lock. Such lobe is desirably of cylindrical shape and the same size as the lower lobe 16 so that the core as a whole is of figure-8 shape in cross section. A retaining lug 24 normally projects from the side of the core in the groove between the two lobes and is retractable by use of a special key. The chamber 12 is of corresponding figure-8 cross section, and may be formed of two overlapping bores in the end of the body 10. Such two bores leave a ridge at each side of the resulting chamber, and the rear portions of such ridges are milled away to leave a shoulder 26 at each side, behind one of which the retaining lug 24 is engaged when the core 14 is mounted in the chamber.

The bore which forms the lower lobe of the core chamber 12 is extended toward the opposite end of the body 10 to form a cylincrical bolt chamber 30. A rotary bolt 32 is rotatably mounted in the bolt chamber 30 and is connected to the key plug 14 by the throw pins 28. Near its forward end (to the left in FIG. 1) the bolt 32 has an annular groove 34 which defines a generally cylindrical head 36. This is cut away at one side to form a channel 38, as indicated in FIG. 2 which will align with the adjacent cable receiving bore when the bolt is turned by the key plug.

An axial cable-receiving bore 40 is formed in the end of the lock body 10 opposite the core chamber 12, and extends inward to the rear face of the annular groove 34 in the bolt 32. Such bore 40 releasably receives an end member 42 at the free end of cable 44. The end member has an annular groove 46 adjacent its end, positioned to be entered by the head 36 of the bolt 32. Such groove 46 defines a head 48 on the end member which engages in the groove 34 and behind the head 36 of the bolt 32, so as to lock the end member 42 in the lock body. Rotation of the bolt 32 by key actuation to bring the channel 38 into alignment with the cable-receiving bore 40 disengages the cable end 42 from the bolt and permits cable retraction and insertion.

The opposite end of the cable 44 carries an end member 50 which is rotatably mounted in a transverse cable-receiving bore 52 positioned axially between the axial first cable-receiving bore 40 and the inner end of the upper lobe of the core chamber 12. The cable end member 50 is secured in the lock body 10 by a retaining pin 54 mounted in the rear wall of the core chamber and normally rendered inaccessible by the presence of the core 14. Preferably, the pin 54 is engaged in an annular groove 56 in the cable end member 50 so as to lock the cable end member 50 in place but allow it to rotate on its axis in the bore 52.

Figure 2:
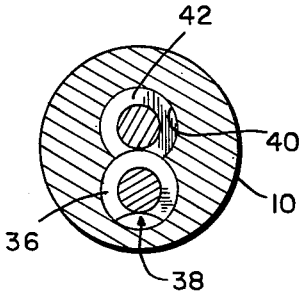
FIG. 2 is a section on the line 2—2 of FIG. 1.
Figure 3:
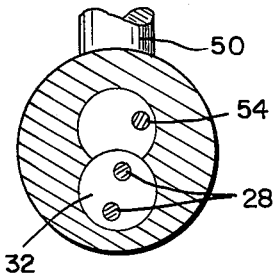
FIG. 3 is a section on the line 3—3 of FIG. 1.
Figure 4:
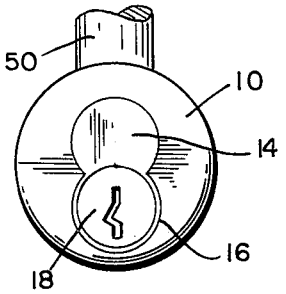
FIG. 4 is an end elevation of the lock shown in FIG. 1, with the lock core inserted in the body.
Figure 5:
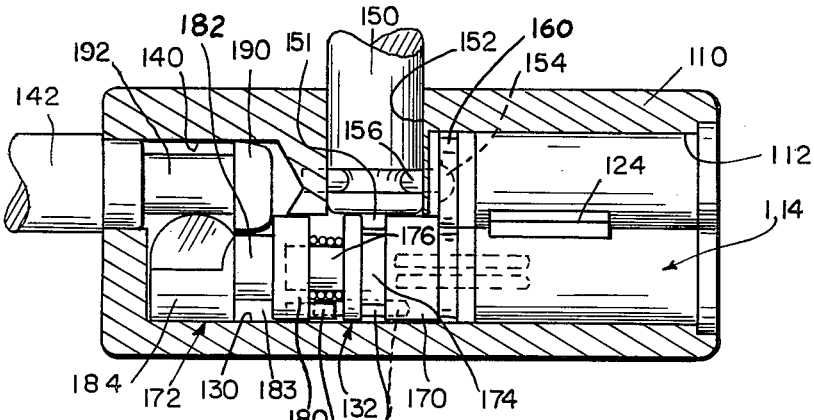
FIG. 5 is a longitudinal section of a modified form of the invention in which the free end of the cable may be inserted to locked position without key actuation of the rotary bolt.
Figure 6:
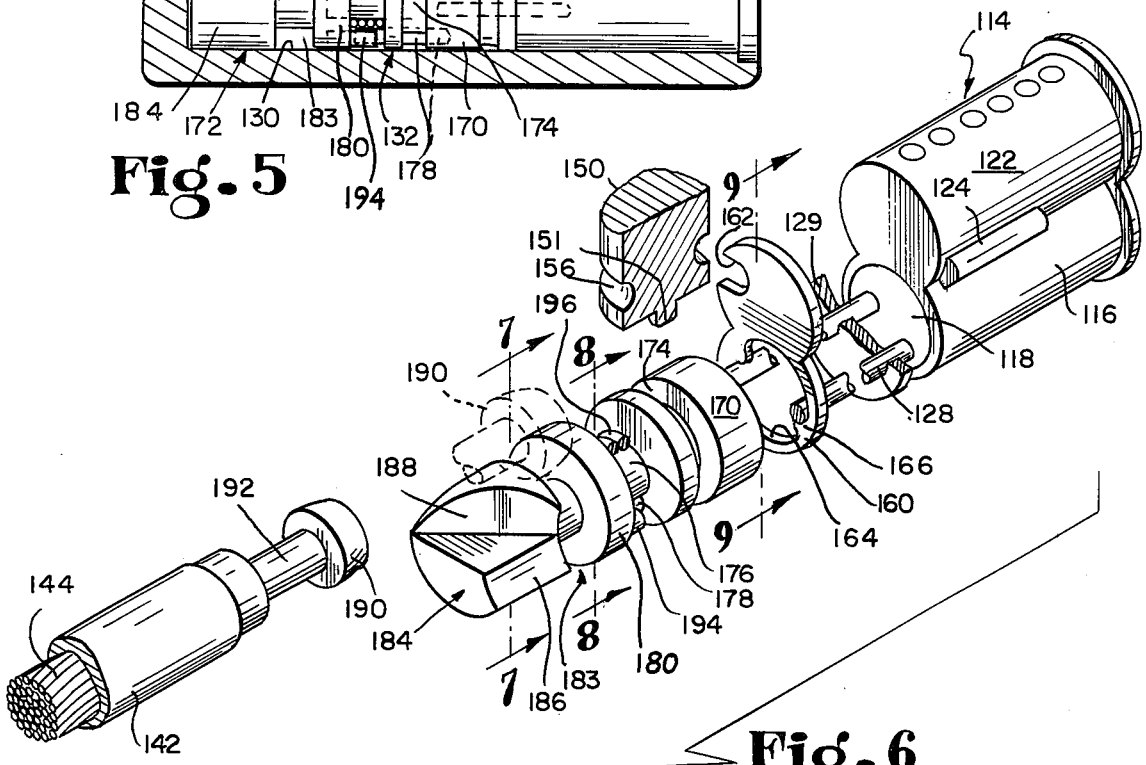
FIG. 6 is an exploded perspective view of the internal parts of the lock shown in FIG. 5.

Operation of this modification of FIGS. 1–4 is as follows. The lock is assembled by inserting the fixed cable end member 50 in the transverse bore 52 and securing it by inserting the pin 54 by way of the core chamber 12. The bolt 32 is then dropped into its chamber 30 and the core 14 inserted, engaged with the throw members 28, and locked in place. The cable end member 42 may then be inserted in the bore 40 by turning the key to rotate the key plug 18 and the rotary bolt 32 to bring the channel 38 of the bolt head 36 into alignment with the bore 40. With the end member in place, the key is turned to return the bolt to its locked position as shown in FIGS. 1 and 2, so as to lock the cable end member 42 in its bore 40. The key is then withdrawn, to leave the parts in locked condition. A similar key actuation will release the releasable cable end member 42 to permit its withdrawal.

The modification shown in FIGS. 5–8 comprises a lock body 110 generally similar to but longer than body 10 of FIG. 1. It contains a core chamber 112 for the reception of a key-removable core 114, formed by two parallel overlapping bores of equal size so as to have a figure-8 cross section. The lower bore is extended to the rear, to form a bolt chamber 130 for the reception of a rotary bolt 132. The opposite end of the body 110 is formed with a bore 140, to receive a releasable cable end member 142 on a cable 144 (shown in FIG. 6). Such bore 140 is a blind bore, which lies in general alignment with the upper bore of the core chamber 112 and in substantial overlapping relation with the bolt bore 130, so that the cable end will interengage the bolt.

The cable-receiving bore terminates a substantial distance from the inner end of the core chamber 112, and in the axial space between such bore and chamber, the body 110 has a transverse or radial bore 152 which receives an end member 150 at the opposite end of the cable. Such end member 150 is retained in the lock body 110 by a retaining pin 154 driven into a drilled hole in the rear wall of the core chamber 112 and engaged with an annular groove 156 near the end of the cable end member 150.

The lock core 114 is like that shown in FIG. 1 and of the type shown in U.S. Pat. No. 3,206,959. It has a lower cylindrical lobe 116 containing a key plug 118, and an upper lobe 122 containing tumbler pins. A retaining lug 124 projects from its side and is retractable with a special control key. The core chamber 112 is correspondingly shaped and has a side shoulder (not shown) for engagement by the retaining lug 124. The rear end of the key plug 118 contains two spaced holes to receive two thrown pins 128. In this modification, such throw pins are fixed in a disk 129 to form a self-contained throw member.

Figure 9:
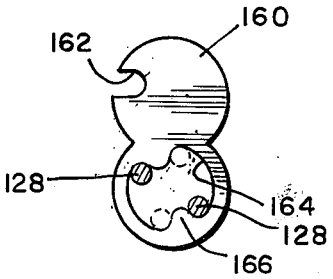
FIG. 9 is a section on the line 9—9 of FIG. 6.

The rotary throw of the throw member 129 is limited by a limit plate 160 formed to fit in the back of the core chamber 112. Its upper lobe contains a notch 162 to clear the head of the retaining pin 154. As best shown in FIG. 9, its lower lobe has a generally circular opening 164, interrupted by two inward-projecting stop lugs 166, positioned to limit the clockwise throw of the throw pins 128 at a normal locked position of the key plug 118, and to limit counterclockwise throw of such pins to an angle of somewhat more than 90°, for example, about 115°.

In this modification, the bolt 132 is formed of two parts, namely a body part 170 and a head part 172 which has limited relative rotational movement with respect to the body part 170. The body part 170 is cylindrical and is rotatably mounted in the bolt bore 130. Its rear face contains a pair of holes to receive the forward ends of the throw pins 128. It is located axially in the bore 130 by a locating stud 151 formed on the end of the cable end member 150 and engaged in a circumferential groove 174 in the body part 170. The body part 170 has a forward projecting axial stud 176 which enters a bore in the rear of the head part 172 and locates the parts in spaced relation. Relative rotation of the parts 170 and 172 is limited by a pair of stop pins 178 and 194. The stop pin 178 is mounted near the periphery of the head part 170 in a position which locates it generally at the bottom of the head part when the bolt is in normal locked position as shown in full lines in the drawings. See FIG. 8. Such stop pin extends across the circumferential groove 174 and projects toward the head part 172 into overlapping relation with the pin 194, as more fully described below.

The head part 172 of the bolt is of generally cylindrical shape and comprises a rear section 180 of full diameter, a reduced diameter portion 182 which defines a circumferential groove 183, and a cam head 184. The cam head has an axially extending channel 186 at one side, which normally lies in a position spaced 90° from the bore 140 which receives the releasable cable end member 142. Such channel is shaped and positioned to come into alignment with the bore 140 when the bolt 132 and its cam head 184 are rotated 90° counterclockwise from the locked position shown in FIG. 6.

The cam head 184 has a cam face 188, which is conveniently formed by cutting the upper half of the cam head 184 at a horizontal angle of approximately 45°, in a plane which intersects the upper half of the rear edge of the axial channel 186, and removing the forward corner of the cam head down to the horizontal central plane thereof.

This disposes the cam face 188 in a plane containing a radius from the axis of the head and disposed at a cam angle to such axis. By cam angle I mean an angle at which axial thrust will produce a substantial component of force in a plane normal to the axis, so that exertion of such thrust eccentrically of the axis will produce a turning moment on the cam head. An angle of 45° is preferred, but other cam angles may be used which produce the desired turning moment.

The cable end member 142 is formed with a reduced portion 192 equal in length to the cam head of the bolt, and with a head 190 adapted to engage in the groove 183 of the bolt head part 172 and behind the cam head 184. The overlapping relation of the cable-receiving bore 140 and the bolt chamber 130 is such that when the cable end member 142 is thrust into its bore 140, as from its full-line position in FIG. 6 to the dotted-line position, its head strikes the cam face 188 and thereby rotates the head part 172 of the bolt so as to bring the channel 186 into alignment with the end member 142. This allows the head 190 of the end member 142 to move past the cam head 184 to the dotted line position shown, where head 190 lies in the bolt groove 183. The head part of the bolt is then free to return to its normal position, where its head part 184 lies in the groove surrounding the reduced neck 192 of the cable end member and behind the cable head 190, and locks the cable end member against withdrawal.

Figure 7:
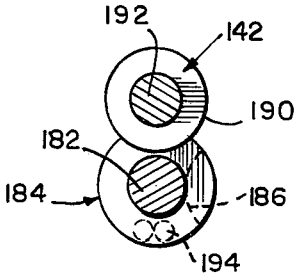
FIG. 7 is a section on the line 7—7 of FIG. 6.
Figure 8:
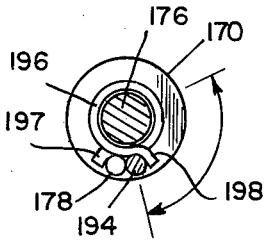
FIG. 8 is a section on the line 8—8 of FIG. 6.

The return (clockwise) rotation of the head part 172 of the bolt 132 relative to its body portion 170, is stopped by the stop pins 178 and 194. The stop pin 194 projects from the rear face of the head part into overlapping relation with the stop pin 178 on the body portion of the bolt. As viewed from the front of the bolt, as shown in FIGS. 7 and 8, the stop pin 194 on the head portion 172 lies at the counterclockwise side of the stop pin 178 on the body portion 170 of the bolt. This stops clockwise relative rotation of the head part but permits relative counterclockwise rotation of that head part 172. Such relative counterclockwise rotation is resiliently opposed by a coil spring 196 having its clockwise end 197 engaged over the stop pin 178 and its counterclockwise end 198 engaged over the stop pin 194.

Operation of the modification of FIGS. 5–9 is as follows: The lock is assembled in the same general way as the modification of FIGS. 1–4. The normal locked position of the bolt and its controlling key plug 118 is as shown in full lines in FIGS. 5 and 9. The releasable cable end member 142 may be inserted without key actuation of the core 118. For such insertion, the cable end member 142 is thrust into the cable-receiving bore 140 from the position shown in full lines in FIG. 6 toward the position shown in dotted lines in FIG. 6. The head 190 of the cable end member engages the cam face 188 and produces a camming action which causes the head portion 172 of the bolt to rotate counterclockwise from the full line position shown through 90°, so as to bring the side channel 186 into alignment with the cable-receiving bore 140, and this permits the head 190 of the cable end member 142 to move past the bolt cam head 184 into the circumferential groove 183 in the bolt head part 172. Such cam rotation is resiliently opposed by the spring 196, and when the cable end member 190 reaches the groove 183, the spring 196 acts to rotate the head portion clockwise back to its locking position as shown in full lines. This locks the cable end member 142 in the bore 140. When the cable is to be released, a key is inserted in the core 114 and the key plug 118 is rotated clockwise as viewed from the key end of the assembly. Such rotation is transmitted by the throw member 128 to the body part 170 of the bolt, and is transmitted by interengagement of the stop pins 178 and 194 to the head part 172 of the bolt. Such rotation carries the channel 186 of the bolt cam head 184 into alignment with the cable-receiving bore 140 so as to permit the cable end member 142 to be withdrawn from that bore 140. Once the cable end member has been withdrawn, the key plug can be returned to locked position and the key withdrawn. The cable can again be reinserted without key actuation, as desired.

In both modifications, the lock is formed of few parts, and these are of simple construction and easily assembled. The core 14 or 114 is normally retained in the chamber 12 or 112 by engagement of the retaining lug 24 or 124 with a shoulder at the side of the chamber, and the core conceals and prevents access to the retaining pin 54 or 154 which retains the cable end member 50 or 150 in the lock body.

The lock of this invention is especially adapted for use with relatively heavy cable, and it locks the rigid end members of the cable in positions at right angles to each other in a common plane, which is a position they naturally assume when the ends of the cable are brought together with the cable looped about or through an object to be secured by the lock. The invention provides a lock which is convenient to use and which provides a high degree of security. It is of especially compact and simple construction. Formation of the lock body requires only four primary machining requirements, namely, four simple boring steps, one to form the lower lobe of the core chamber and the coaxial bolt chamber, one to form the upper lobe of the core chamber, one to form the axial cable-receiving bore, and one to form the transverse cable-receiving bore 152. The modification of FIGS. 5–9, besides its simple construction, also provides the convenience of permitting the cable to be inserted in the lock without key actuation. While this function is not unusual in padlocks, it is believed to be unique and provided by unique mechanism in the present cable lock.

I claim:

1. A cable lock, comprising a lock body, a core chamber formed at one end of said body for receiving a lock core having a key-actuated key plug and a tumbler pin housing projecting radially of said key plug, said chamber having a first portion adapted to contain the key plug of the core and a side portion to contain the pin tumbler housing, a bore extending inward beyond said chamber and a rotary bolt mounted therein in coaxial relation with the key-plug of the core and connected for operation by such key plug, an axial first cable-receiving bore extending inward from the opposite end of the body in parallel overlapping relation with said bolt-receiving bore and in general axial alignment with said chamber side portion, for receiving a cable end member, a second cable-receiving bore formed in said body transversely of and generally coplanar with and axially between said side portion and said first cable-receiving bore, a cable having a first end member thereon secured in said second cable-receiving bore and a second end member on said cable formed for releasable engagement in said axial first cable-receiving bore, said releasable end member and bolt being shaped for interlocking engagement, the bolt having a normal locked position in which it locks such end member in the body and having a key-actuated release position in which it releases such end member for withdrawal from the body.

2. A lock body as in claim 1 in which said first cable end member is secured in said transverse second cable-receiving bore by means of a retainer inserted by way of the core chamber and through the end wall of said side portion in position to be covered and concealed by a core in said chamber.

3. A cable lock as in claim 2 in which said core chamber is formed to receive a key-removable core, in combination with a key-removable core mounted in said chamber and concealing and blocking access to said retainer.

4. A cable lock as in claim 2 in which said first cable end member has a circumferential groove formed therein, and said retaining means is engaged in said groove so as to prevent axial removal of the cable end member from said transverse bore but permit rotation of such member and the cable with respect to the bore.

5. A cable lock, comprising a lock body, a core chamber formed at one end of the body for receiving a key-removable core, said chamber being of figure-8 cross-section formed of a key-plug-receiving bore and a side bore parallel with and overlapping said plug-receiving bore, a bolt-receiving bore coaxial with and extending inward beyond said plug-receiving bore, a first cable-receiving bore substantially in axial alignment with said chamber side bore, spaced axially therefrom, and in parallel intersecting relation with said bolt-receiving bore, a second cable-receiving bore disposed transversely of, generally coplanar with, and axially between said chamber side bore and said first cable-receiving bore, a rotary bolt in said bolt-receiving bore arranged for rotary operation by key-actuation of said key plug, a cable having one end fixed in said transverse second cable-receiving bore and having a cable end member at its opposite end receivable in said first cable-receiving bore, said bolt and cable end member being shaped for interlocking engagement, the bolt having a normal locked position in which it locks such end member in the body and a key-actuated release position in which it releases such end member for withdrawal from the body.

6. A cable lock as in claim 5 in which said one cable end is fixed in an end member having a circumferential groove formed therein, and retaining means is inserted by way of the core chamber through the end wall thereof and engaged in said groove so as to prevent axial removal of the cable end member from said transverse bore but permit rotation of such member and the cable with respect to the bore.

7. A cable lock as in claim 2 in which said rotary bolt has a circumferential groove intermediate its ends, and the cable end member in said transverse bore includes a stud extending into the groove of the bolt to secure the bolt against axial displacement.

8. A cable lock as in claim 1 in which said releasable cable end member is formed with a circumferential groove and a cable head therebeyond, said bolt is formed with a circumferential groove and a keeper head therebeyond, said end member and bolt in locked position being disposed in parallel overlapping position with the head of each in the groove of the other, said keeper head having an axial side channel therein which moves into alignment with the axial cable-receiving bore upon rotation of the bolt to release position so as to release the releasable end member.

9. A cable lock comprising a lock body, a core chamber formed at one end of said body for receiving a lock core having a key-actuated key plug, a bore extending inward beyond said chamber and a rotary bolt mounted therein in coaxial relation with the key-plug of the core and connected for operation by such key plug, an axial first cable-receiving bore extending inward from the opposite end of the body in parallel overlapping relation with said bolt-receiving bore, for receiving a cable end member, a second cable-receiving bore formed in said body, a cable having a first end member thereon secured in said second cable-receiving bore and a second end member on said cable formed for releasable engagement in said axial first cable-receiving bore, said releasable end member and bolt being shaped for interlocking engagement, the bolt having a normal locked position in which it locks such end member in the body and having a key-actuated release position in which it releases such end member for withdrawal from the body, said bolt comprising a body part connected for key-actuation rotation between a locking position and a release position, and a head part mounted for limited rotation relative to said body part, and having a keeper head formed with a side channel which is normally disposed out of alignment with said axial cable-receiving bore, and said releasable cable end member has a cable head at the end thereof axially engageable behind the keeper head of the bolt so as to lock the end member in the lock body, a cam face on said bolt head part positioned and arranged to be engaged by the cable head of said releasable cable end member when the same is thrust endwise into said axial cable-receiving bore and by reaction to such thrust to rotate said keeper head to bring its side channel into alignment with such bore so as to pass the cable head to a position behind the keeper head, and biasing means for rotatably returning said keeper head to a cable locking position when said cable head has passed the keeper head.

10. A cable lock, comprising a lock body, a core chamber formed at one end of said body for receiving a lock core having a key-actuated key-plug, a bore extending inward beyond said chamber and a rotary bolt mounted therein in coaxial relation with the key-plug of the core and connected for operation by such key plug, an axial first cable-receiving bore extending inward from the opposite end of the body in parallel overlapping relation with said bolt-receiving bore, for receiving a cable end member, a second cable-receiving bore formed in said body, a cable having a first end member thereon secured in said second cable-receiving bore and a second end member on said cable formed for releasable engagement in said axial first cable-receiving bore, said releasable end member and bolt being shaped for interlocking engagement, the bolt having a normal locked position in which it locks such end member in the body and having a key-actuated release position in which it releases such end member for withdrawal from the body, wherein said releasable cable end member is formed with a circumferential groove and a cable head therebeyond, said bolt is formed with a circumferential groove and a keeper head therebeyond, said end member and bolt in locked position being disposed in parallel overlapping position with the head of each in the groove of the other, said keeper head having an axial side channel therein which moves into alignment with the axial cable-receiving bore upon rotation of the bolt to release position so as to release the releasable end member, and in which said bolt is connected for rotation between locking position and release position by key operation of a lock core in said lock chamber, and said keeper head is rotatable therebetween independently of key rotation, means biasing the keeper head against such independent rotation, and a cam face on said keeper head positioned and arranged to be engaged by the releasable cable end member when the same is thrust endwise into said axial cable-receiving bore and by reaction to such thrust to rotate against such biasing means to a position to pass said cable end member to locked position.

11. A lock, comprising a lock body, a rotary bolt mounted for rotation on its axis in said body, and having a keeper head at its end, key-actuated means in said body for rotating said bolt, a shackle-receiving bore in parallel overlapping relation with the rotary bolt, a shackle member having a head at its end, said member being axially insertable in said shackle-receiving bore to a locked position in which its head lies behind the keeper head of the bolt, said bolt having a locking position in which its keeper head blocks retraction of the shackle head from said bore and having a side channel movable by key-actuated rotation of the bolt to a release position in which the channel is aligned with the shackle-receiving bore to release the shackle member for retraction, said keeper head being rotatable from locking position to release position independently of key actuation, means biasing said keeper head against such independent rotation, and a cam face on said keeper head positioned and arranged to be engaged by the shackle member when the same is thrust endwise into said cable-receiving bore, and by reaction to such thrust to rotate the head against such biasing means to a position to pass said shackle member to locked position.

12. A lock as in claim 11 in which said cam face lies in a plane containing a radius from the axis of the keeper head and disposed at a cam angle to such axis.

13. A lock as in claim 11 in which said cam face is formed by a flat planar cut across the generally cylindrical head, at a cam angle to the axis thereof.

14. A lock as in claim 11 in which said bolt comprises a body part connected for rotation by said key-actuated means, means mounting the keeper head rotatably and coaxially with respect to the body part, means limiting rotation of the head in one direction relative to the body part, and a coil spring biasing the head for rotation in such direction and resiliently opposing rotation in the opposite direction, said cam face on the head being positioned to cause head rotation in said opposite direction in response to thrust against such face by said shackle member.

15. A lock as in claim 14 in which said mounting means includes a stem extending between said body part and keeper head for supporting the same in coaxial and rotatable relation, stop pins on said body part and keeper head for preventing relative rotation in said one direction, said coil spring being mounted about said stem with its ends engaged with said stop pins.

16. A cable lock comprising a lock body having means defining a lock bore, a bolt bore and first and second cable-receiving bores, the bolt and the first cable-receiving bore both extending generally longitudinally of the axis of the lock bore, the first cable-receiving bore extending inward into the lock body, and the second cable-receiving bore extending generally transversely of the lock bore and first cable-receiving bore into the lock body; a key actuated lock disposed in the lock bore; a bolt disposed in the bolt bore and movable into and out of blocking relationship with the first cable-receiving bore; means for operatively connecting the bolt to the lock for so moving the bolt by key operation of the lock; and a cable having first and second ends, the first end adapted to be received in the first cable-receiving bore and engaged by the bolt when the bolt is in blocking relationship with the first cable-receiving bore, said bolt being a rotary bolt coaxial with the lock bore and the first cable end being formed to provide a first annular groove, the bolt having a keeper head for engaging the first annular groove for holding the first cable end in the lock body, and said keeper head having a side channel movable into alignment with the first cable-receiving bore to release the first cable end for removal from the lock body, the operative connection means between the lock and the keeper head including resilient means for urging the keeper head into engagement with the annular groove, and the bolt including a cam face disposed for engagement by the first cable end when such end is inserted into the first cable-receiving bore, said cam face in response to such engagement being operative to move the keeper head against the urging of the urging means out of blocking relationship with the first bore to allow insertion of the first cable end thereinto.

17. A cable lock comprising a lock body having a core chamber formed at one end to receive a lock core; a lock core received therein and having a key-actuated plug; said lock body further defining a first bolt-receiving bore which extends inward from the bottom of the chamber in coaxial relation with the lock core, a rotary bolt captured between the end of the bolt bore and the inner end of the lock core and connected by throw means for rotation by the key plug; an axial cable-receiving bore which extends inward from the opposite end of the body in parallel overlapping relation with the bolt bore; said lock body further including means defining a second cable-receiving bore, a cable including first and second cable end members, the second cable end member being secured in the second cable-receiving bore; the first cable end member being provided with an annular groove which defines a head at the end of the cable, and the rotary bolt being formed with a complementary head and groove which interengage with the groove and head of the cable end member, the rotary bolt being cut away at one side and being rotatable to a release position by actuation of the key plug in which position the cut-away portion releases the first cable end member for withdrawal from the lock body, said rotary bolt comprising a bolt body part which is coupled to the key plug and a head part which is provided with a cam face and is relatively rotatable with respect to the bolt body part between a locking position and a release position, and means for biasing the head part to its locking position, said cam face being disposed for axial engagement by the first cable end member when such member is thrust into the first cable-receiving bore and being operable in response to such thrust to rotate the head part to its release position so as to permit insertion of the cable end member to a locked position in the first cable-receiving bore.

18. A cable lock, comprising a lock body, a core chamber formed at one end of said body for receiving a lock core having a key-actuated key plug, said chamber having a key-plug-containing portion and a side portion to contain a tumbler pin housing on the core, a bore extending inward beyond said chamber and a rotary bolt mounted therein in coaxial relation with the key-plug of the core and connected for operation by such key plug, an axial first cable-receiving bore extending inward from the opposite end of the body in parallel overlapping relation with said bolt-receiving bore, for receiving a cable end member, a second cable-receiving bore formed in said body on an axis transversely intersecting said bolt-receiving bore, a cable having a first end member thereon secured in said second cable-receiving bore, said bolt having a circumferential groove therein and said first end member having an extension thereon engaged in said bolt groove to secure the bolt against axial displacement, said first cable end member being secured in said second cable-receiving bore by means of a retainer inserted by way of the core chamber and in position to be covered and concealed by a core in said chamber, a second end member on said cable formed for releasable engagement in said axial first cable-receiving bore, said releasable end member and bolt being shaped for interlocking engagement, the bolt having a normal locked position in which it locks such end member in the body and having a key-actuated release position in which it releases such end member for withdrawal from the body.

* * * * *

UNITED STATES PATENT OFFICE

CERTIFICATE OF CORRECTION

Patent No. 4,075,878 Dated February 28, 1978

Inventor(s) Walter E. Best

It is certified that error appears in the above-identified patent and that said Letters Patent are hereby corrected as shown below:

Column 2, line 29, after "14" (second occurrence), insert --is--.

Column 3, line 68, change "thrown" to --throw--.

Column 9, line 41 (Claim 16), after "bolt", insert --bore--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*